United States Patent [19]

Meisner et al.

[11] 3,944,795

[45] Mar. 16, 1976

[54] SETTING MECHANISM FOR DIGITAL DISPLAY DEVICES

[75] Inventors: Alfred Meisner; Oskar Oellig, both of Nurnberg; Josef Neubauer, Grossschwarzenlohe; Bernhard Kratz, Nurnberg-Worzeldorf, all of Germany

[73] Assignee: Diehl, Nurnberg, Germany

[22] Filed: Apr. 22, 1975

[21] Appl. No.: 570,488

[30] Foreign Application Priority Data

Apr. 29, 1974 Germany ..... 2420791
Jan. 25, 1975 Germany ..... 2502982

[52] U.S. Cl. ..... 235/144 ME; 58/125 C
[51] Int. Cl.[2] ..... G04B 19/02; G06C 15/42
[58] Field of Search ..... 58/23 R, 34, 85.5, 125 C; 235/1 C, 144 E, 144 EA, 144 ME

[56] References Cited

UNITED STATES PATENTS 1,858,397 5/1932 Friden ..... 235/144 ME
2,544,610 3/1951 Nelson ..... 235/144 ME
2,900,787 8/1959 Blouin ..... 58/34 X

*Primary Examiner*—Edith Simmons Jackmon
*Attorney, Agent, or Firm*—Spencer & Kaye

[57] ABSTRACT

A setting mechanism incorporated in a digital display device which includes a movable first digit carrier; a motor driving the first digit carrier in a normal digit-advancing operation; and a movable second digit carrier. The setting mechanism has a drive member continuously driven by the motor, a clutch connected between the drive member and the second digit carrier. The clutch, when in its engaged state, couples the drive member to the second digit carrier for imparting a setting motion to the latter; and a manually operable actuator connected to the clutch for operating the same.

19 Claims, 11 Drawing Figures

SETTING MECHANISM FOR DIGITAL DISPLAY DEVICES

BACKGROUND OF THE INVENTION

This invention relates to a setting mechanism for digital display devices used, for example, in time measuring apparatus which includes a drive motor which also serves for the adjustment (setting) of time indication. The setting mechanism includes a manual actuator with which a motorized adjustment of the time indication can be effected by actuating a clutch mechanism.

Setting mechanisms of the above-outlined type for digital display devices, for example digital clocks, are known by themselves. Earlier, a setting of the digit rollers was effected mostly by a manual rotation of the shaft carrying the digit rollers. For a longer setting such levers have, in most cases, a diameter which is much too small. Further, for example, in case of a 24-hour display, substantial time is needed to set the clock several hours up to 24 hours. Also, the setting mechanism for a manual setting of the digit roller in a digital clock in which the setting knobs are at the front plate, is usually of relatively complex structure. Further, motorized setting mechanisms for digital display devices are known in which a stepped advance of the time or, as the case may be, the digital display and the setting (adjustment) of the display is possible. The setting is effected, for example, by means of additional drives, carrier and locking mechanisms which have contributed significantly to the complexity, the spatial requirement and the overall expense of the apparatus.

SUMMARY OF THE INVENTION

It is an object of the invention to provide a setting mechanism for digital display devices for a step-by-step advance and a rapid setting of display with a small number of structural components to insure a simple and inexpensive, easily mass-producible setting mechanism for digital display devices wherein, in addition to setting the digital clock display, it is also possible to set one or more additonal digital displays.

This object and others to become apparent as the specification progresses, are accomplished by the invention, according to which, briefly stated, in addition to the time display there are provided one or more additional digital displays in the time measuring apparatus and further, the aboe-mentioned drive motor is also used for the setting of the additional digital displays. Further, there are provided one or more actuators, one associated with each digital display, for rendering operative a clutch device for the purpose of a motorized setting of the digital displays.

The advantage of the invention resides particularly in that one setting mechanism is provided for adjusting several digital displays by means of one motor and that in case of digital time measuring devices, such as digital clocks or timing switches, the motor which is, in any event, a necessary part of the mechanism, can be used for the setting of the digital displays.

It is a further advantage of the invention that with the simplest means and only with an insignificant number of components, for example, an operating key, a pivotal lever and two rollers which are driven by a motor, a setting mechanism can be obtained for adjusting a plurality of digital displays. By using the already available motor for setting additional digital displays, the time necessary for the adjustment is significantly shortened when compared to a manual adjustment. The advantage of an embodiment of the invention resides in the fact that the setting device according to the invention makes possible a step-by-step advance and a setting of the digital time display and of one or more additional digital displays merely by means of the drive and the stepping gear for the step-by-step advance of the time display. Stated differently, the stepping mechanism for the step-by-step advance is so designed that it also serves as the drive means for the setting motion and such setting motion is effected merely by rendering a clutch device operative. Thus, the invention makes possible a step-by-step advance and a setting of a time display and one or more additional digital displays with the simplest means constituted by a very small number of inexpensive components.

DESCRIPTION OF THE PREFERRED EMBODIMENTS

Figure 1:
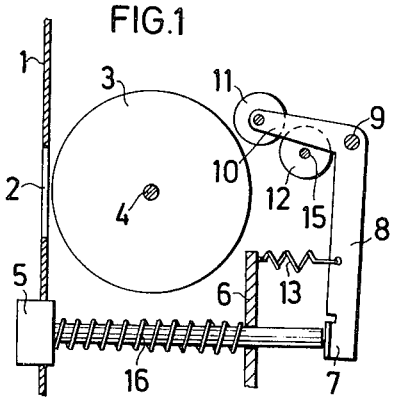
FIG. 1 is a schematic side elevational view of a preferred embodiment in a non-operating state.

Turning now to FIG. 1, the setting device according to the invention is shown therein in its disengaged, non-operating state. There is shown a front plate 1 provided with a window 2 behind which there is positioned a roller 3 carrying digits on its cylindrical periphery. The digit roller 3 is freely rotatable and is supported on a shaft 4. The front plate 1 is provided with a further opening through which projects a manually operable actuating member which may be designed as a key 5 formed of a push button and an actuating rod attached thereto. The actuating rod of the key 5 is guided and supported in a housing wall 6 and is in engagement with the end of one arm 7 of a bell crank lever 8 pivotally supported on a shaft 9. On the end of the other arm 10 of the lever 8 there is supported a freely rotatable setting roller 11.

The mode of operation of the setting device according to the invention will now be described with reference to FIGS. 1 and 2.

In FIG. 1 the setting roller 11 is disengaged from both the digit roller 3 and a drive roller 12, since the pivotal lever 8 is maintained by means of a tension spring 13 and an abutting relationship between the actuating rod of the key 5 and the terminus of the arm 7 at a clearance from the digit roller 3 and the drive roller 12. The tension spring 13 is attached to the arm 7 and the support 6. The drive roller 12 is keyed to a drive shaft 15 which is continuously driven, for example, by a synchronous motor 14 as illustrated in FIG. 3.

Figure 2:
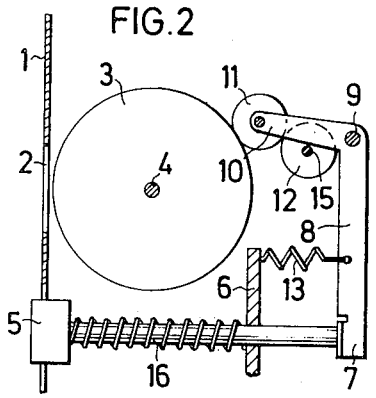
FIG. 2 is a schematic side elevational view of the same embodiment in an operating state.

FIG. 2 shows the setting device in its operating state. For the purpose of shifting the setting device into the operating state, the key 5 is depressed against the force of a spring 16 which is supported by the housing component 6. As a result of the actuation of the key 5, the end of the arm 7 of the pivotal bell crank lever 8 is shifted towards the right (as viewed in FIGS. 1 and 2) so that the bell crank lever 8 executes a counterclockwise rotation on its support shaft 9. At the same time, the terminus of the crank arm 10 is moved in between the digit roller 8 and the drive roller 12. Thus, the setting roller 11 is, due to the depression of the key 5, now in engagement with the digit roller 3 and the drive roller 12. Since the latter is continuously drive by the shaft 15, this rotary motion is transmitted as a setting motion to the digit roller 3 of the digital display device. As soon as the key 5 is released, the setting roller 11 is again disengaged from the digit roller 3 and the drive roller 12 and, as a result, the digit roller 3 will stop immediately, thus terminating the setting operation. It is to be understood that the key 5 may be so designed that it has a locked position which makes it possible to effect longer settings, for example, for a 24-hour digital clock, without the necessity of maintaining the key 5 continuously depressed manually.

The digit roller 3, the setting roller 11 and the drive roller 12 may be made of a synthetic material; the material of the setting roller 11 is expediently elastic. The setting roller 11 and the drive roller 12 may be designed as friction rollers or may be provided with meshing teeth in which case then the digit roller 3 too, is provided with complemental teeth. The inward swing of the setting roller 11 may be radial as in the embodiment illustrated, or may conceivably be axial.

Figure 3:
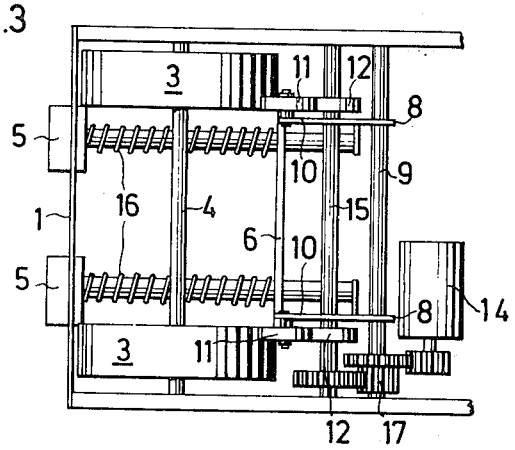
FIG. 3 is a schematic top plan view of the same embodiment for the setting of several additional digital displays.

FIG. 3 illustrates a pair of setting devices in a top plan view. It is to be understood that three, four, or even more setting devices may be juxtapositioned for adjusting different digital displays. Thus, for example, either the digital clock display or the digital displays for the setting of operational periods, alarm settings, beginning and/or termination of cooking processes, cooking periods, etc., can selectively be adjusted by means of a single motor. The synchronous motor 14 continuously drives the drive rollers 12 through a step-down gear 17. The transmission ratio of the step-down gear 17 is so selected that the digits on each digit roller 3 move past the window in the front panel 1 during the depressed state of the proper key 5 with such a speed that the numerals are still visually perceptible. In the shown embodiment the setting of each digit roller 3 is effected always in one direction. It is to be understood that by providing a corresponding drive with an associated reversing mechanism, the setting of the digit rollers 3 may be effected in an opposite direction.

The structure illustrated in FIG. 3 combines two setting devices shown in FIGS. 1 and 2. The setting of the digit rollers 3 is in each instance effected by the depression of a separate key 5 as described above in connection with FIGS. 1 and 2. The drive shaft 15 which is continuously driven by the synchronous motor 14 carries two drive rollers 12 for driving the one and the other setting device, respectively. In case there are provided three or four or even more setting devices in a juxtaposed orientation, there would be needed three or four or more drive rollers 12 attached to the same drive shaft 15. The arrangement of a plurality of setting devices side by side may be designed in such a manner that each key which is associated with a separate setting device for a separate function, projects separately from the front plate 1 as it may be observed in FIG. 3. It is, however, feasible to combine the switch functions of two keys associated with the operation of two setting devices for two separate displays in a sole actuating device by providing, for example, only one key which, in its pulled-out position and in its pushed-in condition, serves the one or the other setting device, respectively. It is further to be understood that the setting of several displays with a motor may be applied not only in digital displays but also in analog displays.

Figure 4:
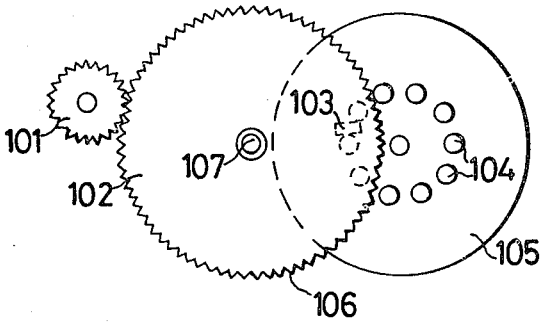
FIG. 4 is a schematic side elevational view of a part of another preferred embodiment of the invention adapted for the stepped advance of a time display.

Turning now to FIG. 4, there is shown a device which is designed solely for a stepped advance of a time display. There is provided a pinion 101 which drives a stepping gear 102. The latter is provided with a stepping lug 103 which periodically engages pins 104 of a lantern gear of a digit roller 105. The latter may be, for example, the first digit roller of a digital clock. Assuming that the first digit roller indicates the minutes in a digital clock, the lantern gear comprises ten pins 104. The stepping gear 102 in such a case has a speed of 1 rpm so that the stepping lug 103 rotates the display roller 105 one step per minute by virtue of the interengagement between the stepping lug 103 and the pins 104 of the lantern gear. The drive of the stepping gear 102 may be effected, for example, by a synchronous motor with the intermediary of a step-down gear wherein the last transmission element is on the stepping gear 102. In addition to the stepping lug 103, the stepping gear 102 has, for this purpose, a second tooth assembly 106 constituting the last transmission element of the step-down gear. It is to be understood that the pinion 101 and the stepping gear 102 may be designed as friction wheels or the drive of the stepping gear 102 may be effected directly by the shaft 107 of the stepping gear.

Figure 5:
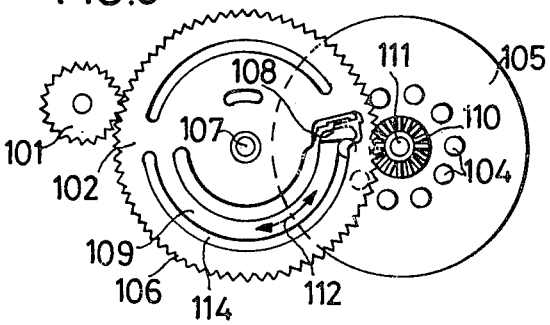
FIG. 5 is a schematic side elevational view of a part of a further preferred embodiment of the invention for the stepped advance and setting of a time display and additional digital displays.

FIG. 5 illustrates a further embodiment of the invention. The setting device illustrated therein makes possible a stepped advance and also, an adjustment of a time display and of one or more additional digital displays with the aid of a clutch device. This setting device comprises a pinion 101 which drives a stepping gear 102 supported on a shaft 107. The drive of the stepping gear 102 is effected in a manner described in connection with FIG. 4. The stepping gear 102 has a stepping lug 108 which is resiliently supported by an arm 109. The latter forms an integral part of the stepping gear 102. Expediently, the stepping gear is made of a resilient material, such as a synthetic material, adapted for mass production, for example, by means of an injection molding process.

Figure 6:
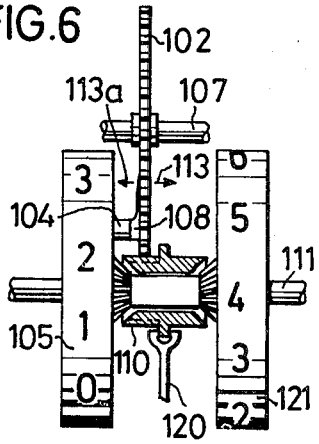
FIG. 6 is a front elevational view of another preferred embodiment of the invention including a clutch mechanism in the disengaged state.

The mode of operation of this embodiment will now be described in further detail with reference to FIGS. 5, 6 and 7. The stepping gear 102 has two functions to perform in the setting device according to the invention. Its first function is the stepped advance of the time display and its second function is to serve as a drive member for the adjustment of the time display and of one or more additional digital displays.

Figure 8:
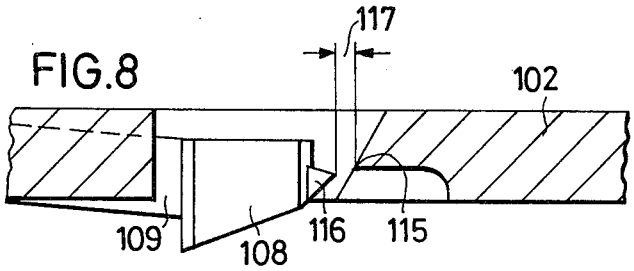
FIG. 8 is a fragmentary sectional view of a stepping gear shown disengaged from the digit roller of a digital time display device.
Figure 9:
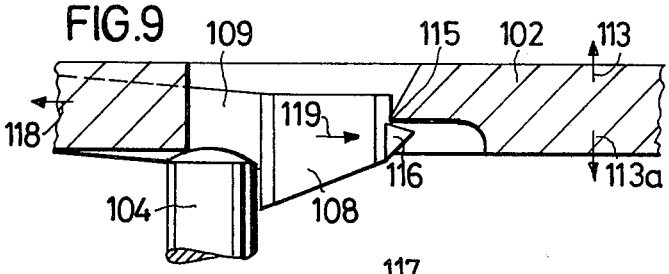
FIG. 9 is a sectional view of the component of FIG. 8, illustrated in a form-locking engagement with the digit roller of the time display device.

Considering first the stepped advance of the time display, the step-by-step motion of the digit roller 105 occurs similarly to that described in connection with FIG. 4. The digit roller 105 may be again, for example, a minute roller of a digital clock and thus it carries ten pins 104 constituting a lantern gear. Thus, again, the digit roller 105 is advanced by one step every minute by means of the stepping component of the stepping gear 102. Since the arm 109 carrying the stepping lug 108 is made of an elastic and thus springing material, the stepping lug arranged at the free terminus of the arm 109 may, upon influence of corresponding forces, move either in the circumferential direction 112 of the stepping gear 102 backward or forward, or in the axial directions 113 and 113*a* of the stepping gear 102 as shown in FIGS. 6 and 7. The position of rest (normal position) of the springing lug 108 is illustrated in FIG. 8 in a sectional view taken through the stepping gear 102. The arm 109 which is freely movable in a recess 114 of the stepping gear 102 illustrated in FIG. 5, positions the stepping lug 108 in its state of rest in such a manner that the lug 108 or, more precisely, a locking nose 116 provided thereon, does not touch an edge 115 of the stepping gear 102, but maintains a distance 117 between the locking nose 116 and the edge 115. If, for example, during a minute step of the stepping gear 102, a pin 104 of the lantern gear arrives into engagement with the stepping lug 108, the latter, if the stepping gear 102 rotates in the direction 118 upon stepping, is shifted by the momentarily stationary pin 104 in the direction 119 until the stepping lug 108 abuts against the edge 115 of the stepping gear 102 (FIG. 9). A motion through the distance 117 by the stepping lug 108 is possible since the arm 109 is capable to move forward and backward in the circumferential direction 112.

Only when the lug 108 is pressed against the edge 115 of the stepping gear 102 by the pin 104 of the momentarily stationary digit wheel 105, does the motion of the stepping gear 102 in the direction 118 cause a displacement of the pin 104 and thus a one-step shift of the digit roller 105 in the direction 118. The locking nose 116 on the stepping lug 108 serves for the lateral locking of the stepping lug 108 which means that the stepping lug 108 is prevented by the locking nose 116 from moving laterally in the axial direction 113 of the stepping gear 102. By means of the above-described design of the stepping gear 102 it is ensured that during stepping of the stepping gear 102, there will be at all times a form-locking contacting drive between the stepping lug 108 and the stepping elements (constituted by the pins 104) of the digit roller 105. Upon completion of the stepping advance of the digit roller 105, the stepping lug 108 returns, by virtue of the resilient arm 109, into its position of rest as shown in FIG. 8, so that the clearance 117 will re-appear between the stepping lug 108 or, as the case may be, its locking nose 116 and the edge 115 of the stepping gear 102.

It was shown above that the setting device or, more particularly, the stepping gear according to the invention makes possible a form-locking stepped advance of a digit roller in a time display device. At the same time, however, the stepping gear 102 is used not only for a stepped advance of the digit roller, but also for adjusting this time display and one or several additional digital displays. The adjustment of a time display and one or several additional digital displays is effected with the aid of a clutch pinion 110. The latter is in continuous engagement with the stepping gear 102, that is, it is driven continuously, similar to the stepping gear 102 as seen in FIGS. 5, 6 and 7. The clutch pinion 110 is shiftably supported on a shaft 111 which serves simultaneously as the support shaft for the digit rollers of the digital clock or the additional digital display devices. The clutch pinion 110 may be displaced by means of an actuating element 120 in the axial directions 113 and 113*a* of the stepping gear 102. It is to be noted that the shaft 107 and 111 are oriented parallel to one another. In FIG. 6 there is illustrated a setting device at a moment when there occurs merely a stepped advance of the digit roller 105 by means of the stepping gear 102 or, more particularly, by the stepping lug 108; stated differently, the clutch pinion 110 is not in engagement with the digit roller 105. For purposes of better visibility there is shown only a single pin 104 of the lantern gear of the digit roller 105. The form-locking engagement during stepped advance of the stepping lug 108 in the lantern gear may be best observed in FIG. 9.

Figure 7:
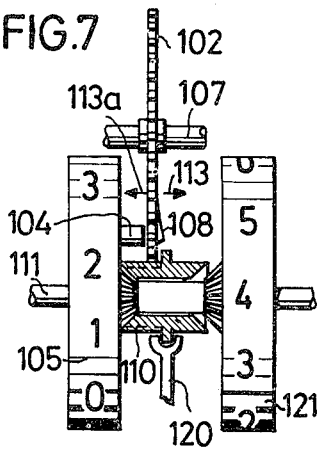
FIG. 7 is a front elevational view of the same embodiment in an engaged state.

A setting operation for a digit roller, for example, a digit roller 105, of a digital clock is illustrated in FIG. 7. The clutch pinion 110 is brought into driving connection with the digit roller 105 by means of the actuating element 120. The drive of the digit roller 105 is effected by the clutch pinion 110 by means of a cone clutch. The digit roller 105 carries at the sides oriented towards the pinion 110, an external cone of a cone clutch, whereas the clutch pinion 110 is, accordingly, provided with an inner cone of the cone clutch. By virtue of moving the clutch pinion 110 by means of the actuating element 120 in the axial direction 113*a*, the digit roller 105 is coupled to the clutch pinion 110. Since the clutch pinion 110 is in continuous engagement with the stepping gear 102, that is, similar to the stepping gear 102, it rotates continuously, the digit roller 105 starts to rotate immediately with the higher speed of the clutch pinion as compared to the stepping gear 102. The transmission ratio between the stepping gear 102 and the clutch pinion 110 is selected in such a manner that the time digit rollers or the other digit rollers move with a speed which still permits a visual perception of the digits on the digit roller.

The precedingly described setting operation for the digit roller 105 may also be effected for one or more further digital display rollers which are also mounted on the shaft 111. By means of the actuating element 120 the clutch pinion 110 is then moved in the axial direction 113, so that, by means of a separately provided conical clutch, there is effected a coupling of a further digital display roller 121. The outer cone of the cone clutch is situated on the digital display roller, whereas the inner cone is provided on the clutch pinion 110. It is to be understood that any other arrangement may be chosen; for example, the outer and inner cones may be reversed or another type of clutch may be used altogether. By virtue of coupling a further digit roller 121 to the clutch pinion 110, the roller 121 rotates with the setting speed of the clutch pinion 110. For legibility and settability, the same criteria are set as for the time display roller 105 described above. It is possible to provide not only one, but several additional display rollers; thus, for example, the digital display rollers mounted on the shaft 111 may have a hollow axis which can be telescoped into another; in such a case the clutch pinion or the entire clutch assembly has to be designed accordingly.

Figure 10:
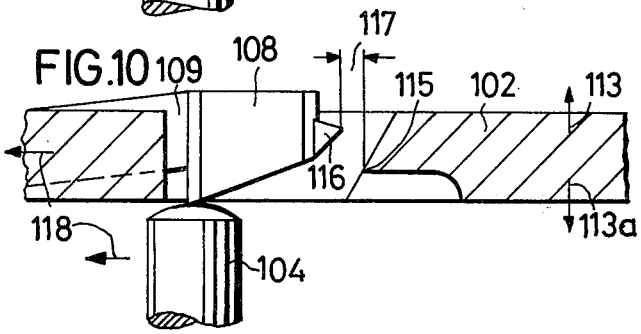
FIG. 10 is a sectional view of the same component during the adjustment of the digit roller of the time display device.

If now during a setting operation of, for example, digital time display roller 105, the latter, by virtue of the engagement with the clutch pinion 110, rotates with a higher speed than the stepping gear 102 (both the stepping gear 102 and the digit roller 105 rotate in the same direction), the digit roller 105 or, more precisely, the lantern gear with the pins 104 begin to overtake the stepping gear 102. This occurrence is depicted in FIG. 10. Although the stepping lug 108, as a component of the stepping gear 102, also rotates in the direction 118, the stepping lug 108, by virtue of the increased speed during the setting operation, overtakes the pins 104 of the lantern gear carried by the stepping gear 102. During this occurrence, the pins 104 deflect the stepping lug 108 in the axial direction 113 of the stepping gear 102. Such a deflection is made possible by the arm 109 which is also resiliently movable in the axial direction. At the beginning of the setting operation it is of no significance whether the stepping lug 108 is in a position of rest as shown in FIG. 8, into which it can be moved in any event in the axial direction by one of the pins 104, or whether the stepping lug 108 is in engagement with the edge 115 of the stepping gear 102 as shown in FIG. 9. A setting is possible independently from the engagement of the stepping lug 108 with the lantern gear during the stepping operation. Since, as the rapid setting motion starts, the pin 104 (FIG. 9) moves more rapidly in the direction 118 than the stepping gear 102 and the lug 108, the latter may and will return into its position of rest by virtue of its arrangement on the arm 109. This means that the stepping lug 108 moves into the direction 118, so that the distance 117 between the locking nose 116 and the edge 115 of the stepping gear 102 will reappear as shown in FIG. 8. Thus, the stepping lug 108 can, at any time, be deflected in the axial direction 113 by a pin 104 during a setting operation, as illustrated in FIG. 10.

The above-described design of the stepping gear thus makes possible, in addition to a stepped advance of a time display, a simultaneous setting of the time display and of one or more additional digital displays with the aid of a clutch pinion driven by the stepping gear. What is of significance here is the cooperation of the above-discussed features which permit the setting device to effect a stepped advance as well as a setting of one or several additional display devices and to carry out this function with the simplest means, that is, with a stepping gear and a clutch pinion which both may be mass-produced components made of a synthetic material. In this embodiment, the features of a stepping device required for the step-by-step advance of a time display are combined in an advantageous manner with the features and measures for a setting device in a single setting mechanism. Only by means of this combination could such a simple device be obtained which carries out both functions simultaneously.

Figure 11:
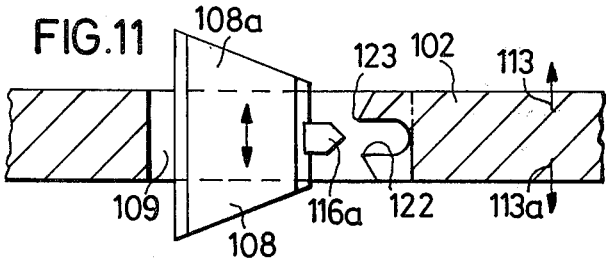
FIG. 11 is a sectional view of the same component associated with another embodiment of the invention.

In a further development of the invention, the stepping lug 108 is so designed that it extends on both sides of the stepping gear 102 as illustrated in FIG. 11. For this purpose, the stepping lug 108 is complemented by a second lug **108*a*; these two lugs are arranged symmetrically with respect to the stepping gear 102 and are mounted on the arm 109. The dual lug 108, 108*a* has a locking nose 116*a* which cooperates with two edges 122 and 123 of the stepping gear 102. The stepping elements (lantern gears) of at least two digit rollers may be arranged on both sides of the stepping gear 102. This possibility, however, is not illustrated in the drawing. Thus, by means of the dual lug 108, 108*a* stepped advances of at least two digit rollers may be effected and simultaneously, similarly to the previously described embodiment, a rapid setting of the digit rollers may be carried out. In a further embodiment of the invention, in the stepping gear 102** there are arranged a plurality of stepping arms carrying stepping lugs. With the aid of stepping lugs arranged on a plurality of stepping arms there may be effected a more rapid stepping of digit rollers of a predetermined number, without limiting the settability of any of the digit rollers.

It will be understood that the above description of the present invention is susceptible to various modifications, changes and adaptations, and the same are intended to be comprehended within the meaning and range of equivalents of the appended claims.

What is claimed is:

1. A setting mechanism incorporated in a digital display device which includes a movable first digit carrying means; a motor driving the first digit carrying means in a normal digit-advancing operation; and a movable second digit carrying means; wherein the improvement comprises:

a. a drive member continuously driven by said motor;

b. clutch means connected between said drive member and said second digit carrying means, said clutch means having an engaged and a disengaged state; said clutch means, when in its said engaged state, coupling said drive member to said second digit carrying means for imparting a setting motion to the latter; and c. manually operable actuating means connected to said clutch means for placing said clutch means from one of its states into the other.

2. A setting mechanism as defined in claim 1, wherein said second digit carrying means is constituted by a digit roller; said drive member including a drive shaft continuously rotated by said motor and a drive roller affixed to said drive shaft; said clutch means including a lever having first and second ends, pivot means for swingably supporting said lever between said first and second ends, and a setting roller freely rotatably supported on said first end of said lever and disposed between said digit roller and said drive roller, said lever having one position in which said setting roller carried by said lever is disengaged from said digit roller and said drive roller; said lever having another position in which said setting roller is in engagement with said digit roller and said drive roller for effecting a setting motion of said digit roller by said motor; said manually operable actuating means including a movable component connected to said second end of said lever for moving said lever from one of its positions into the other.

3. A setting mechanism as defined in claim 1, wherein the transmission ratio between said drive member and said digit carrying means through said clutch means being such that the speed of said digit carrying means during the setting motion thereof just permits visual perception of the digits on said digit carrying means.

4. A setting mechanism as defined in claim 1, wherein there is provided a plurality of second digit carrying means, clutch means and manually operable actuating means; with each said second digit carrying means there is associated a separate one of said clutch means and a separate one of said actuating means; each of said clutch means cooperating with said drive member.

5. A setting mechanism as defined in claim 4, wherein each said second digit carrying means is constituted by a digit roller; said drive member including a drive shaft continuously rotated by said motor and a plurality of drive rollers affixed to said drive shaft; each said clutch means including a lever having first and second ends, pivot means for swingably supporting said lever between said first and second ends, and a setting roller freely rotatably supported on said first end of said lever and disposed between said digit roller and an associated one of said drive rollers, each said lever having one position in which the setting roller carried by the lever is disengaged from the associated said digit roller and drive roller; said lever having another position in which the setting roller is in engagement with said associated digit roller and drive roller for effecting a setting motion of said associated digit roller by said motor; each said manually operable actuating means including a movable component connected to said second end of an associated one of the levers for moving the lever from one of its positions into the other.

6. A setting mechanism as defined in claim 4, said digital display device includes a front plate through which digits of said digit carrying means are visible; each said actuating means projecting outwardly through said front plate.

7. A setting mechanism as defined in claim 1, wherein said first and second digit carrying means are constituted by respective first and second digit rollers; further comprising:

d. a stepping gear connected to said drive member for continuous rotation by said motor;

e. a stepping member secured to and carried in an orbital motion by said stepping gear;

f. a plurality of stepping elements affixed to said first digit roller; said stepping member, upon rotation of said stepping gear, periodically engaging said stepping elements for effecting a step-by-step advance of said first digit roller;

g. a clutch pinion forming part of said clutch means, and being in continuous engagement with said drive member to be continuously rotated by said motor, said clutch pinion having a first position in which it is disengaged from said first and second digit rollers; said clutch pinion having a second position in which it is in engagement with said first digit roller for coupling said first digit roller to said drive member through said clutch means for effecting a setting motion of said first digit roller by said motor; said clutch pinion having a third position in which it is in engagement with said second digit roller for coupling said second digit roller to said drive member through said clutch means for effecting a setting motion of said second digit roller by said motor; said manually operable actuating means being coupled to said clutch pinion for moving said clutch pinion into its different positions; and h. means rendering said stepping member ineffective during the setting motion of said first digit roller.

8. A setting mechanism as defined in claim 7, wherein said stepping elements on said stepping gear are constituted by pins which together form a lantern gear.

9. A setting mechanism as defined in claim 7, wherein said clutch means is constituted by a cone clutch; said clutch pinion having at each end a separate inner bevel.

10. A setting mechanism as defined in claim 9, wherein said first and second digit rollers are supported in axial alignment and spaced from one another; said clutch pinion being positioned between said first and second digit rollers; said cone clutch further including outer bevels secured to those faces of said first and second digit rollers that are oriented towards said clutch pinion; said outer bevels cooperating with the inner bevels of said clutch pinion.

11. A setting mechanism as defined in claim 7, said drive member being constituted by said stepping gear; said stepping member being formed of a stepping lug; said means rendering said stepping member ineffective including a support resiliently securing said stepping lug to said stepping gear; said stepping lug being arranged to be deflected by said stepping elements during the setting motion of said first digit roller; said clutch pinion being in continuous engagement with said stepping gear to be continuously rotated by said stepping gear.

12. A setting mechanism as defined in claim 11, wherein said first and second digit rollers are mounted on a common shaft having an axis; said clutch pinion being supported on said shaft between said first and second digit rollers and being displaceable parallel to said axis by said actuating means into one of its three positions.

13. A setting mechanism as defined in claim 11, wherein the transmission ratio between said stepping gear and said clutch pinion and between said clutch pinion and either digit roller is such that the rpm of the digit rollers during setting motion is greater than the rpm of said first digit roller during the step-by-step advance effected by the cooperation between said stepping lug and said stepping elements.

14. A setting mechanism as defined in claim 11, wherein said support is resilient in the circumferential direction of said stepping gear.

15. A setting mechanisn as defined in claim 11, wherein said support is resilient in a direction parallel to the rotary axis of said stepping gear.

16. A setting mechanism as defined in claim 15, wherein said support is constituted by a resilient arm having one end affixed to said stepping gear and having another end carrying said stepping lug.

17. A setting mechanism as defined in claim 15, including a locking nose carried by said stepping lug; said stepping gear further including an edge portion adjacent to and normally spaced from said locking nose; said edge portion prevents a displacement of said support in a direction parallel to the rotary axis of said stepping gear when in engagement with said locking nose upon movement of said lug in the circumferential direction of said stepping gear by one of said stepping elements.

18. A setting mechanism as defined in claim 17, wherein said stepping lug, in an axially non-deflected position of said support, projects axially in both directions from said stepping gear.

19. A setting mechanism incorporated in a digital display device which includes a movable digit roller; stepping elements affixed to the digit roller; a stepping gear; a motor connected to the stepping gear for continuously rotating the latter; a stepping member secured to and carried in an orbital motion by said stepping gear; the stepping member, upon rotation of the stepping gear, periodically engaging the stepping elements for effecting a step-by-step advance of the digit roller; wherein the improvement comprises in combination a. a clutch pinion in continuous engagement with said stepping gear; said clutch pinion having a first position in which it is disengaged from said digit roller;

said clutch pinion having a second position in which it is in engagement with said digit roller for coupling said digit roller to said stepping gear through said clutch pinion for effecting a setting motion of said digit roller by said motor;

b. a manually operable actuating means being coupled to said clutch pinion for moving said clutch pinion from one of its positions into the other; and c. means rendering said stepping member ineffective during the setting motion of said digit roller.

* * * * *